US009463855B2

(12) United States Patent
Stone, Jr.

(10) Patent No.: US 9,463,855 B2
(45) Date of Patent: Oct. 11, 2016

(54) PROPULSION DEVICE FOR SAILBOAT

(71) Applicant: David B. Stone, Jr., Williamsport, PA (US)

(72) Inventor: David B. Stone, Jr., Williamsport, PA (US)

( * ) Notice: Subject to any disclaimer, the term of this patent is extended or adjusted under 35 U.S.C. 154(b) by 0 days.

(21) Appl. No.: 14/691,839

(22) Filed: Apr. 21, 2015

(65) Prior Publication Data

US 2015/0307175 A1 Oct. 29, 2015

Related U.S. Application Data

(60) Provisional application No. 61/983,064, filed on Apr. 23, 2014.

(51) Int. Cl.
*B63H 1/36* (2006.01)
*B63H 25/38* (2006.01)
*B63H 16/08* (2006.01)

(52) U.S. Cl.
CPC ..... *B63H 1/36* (2013.01); *B63H 16/12* (2013.01); *B63H 25/382* (2013.01)

(58) Field of Classification Search
CPC ..... B63H 1/36; B63H 5/00; B63H 16/08; B63H 25/38; B63H 25/381; B63H 25/382
USPC ..... 114/162; 440/15
See application file for complete search history.

(56) References Cited

U.S. PATENT DOCUMENTS

| | | | | |
|---|---|---|---|---|
| 2,365,415 | A | 5/1944 | Kruse | |
| 2,809,604 | A | 4/1955 | Meredith | |
| 4,750,446 | A * | 6/1988 | Sussman | B63B 15/00 114/102.24 |
| 6,022,249 | A | 2/2000 | Ketterman | |
| 6,079,344 | A | 6/2000 | Wang et al. | |
| 6,843,691 | B1 | 1/2005 | Jelten | |
| 6,997,765 | B1 | 2/2006 | McGuiness | |
| 8,210,888 | B2 | 7/2012 | Chambers | |
| 8,607,724 | B2 | 12/2013 | Metwally et al. | |
| 2008/0207070 | A1 | 8/2008 | Van Gelder | |

FOREIGN PATENT DOCUMENTS

IE GB 2326143 A * 12/1998 ..... B63H 1/36

* cited by examiner

*Primary Examiner* — Lars A Olson
(74) *Attorney, Agent, or Firm* — Wendy W. Koba

(57) ABSTRACT

A propulsion device for providing forward movement of a sailboat in the absence of wind takes the form of a flexible fin that is removably attached to a sailboat rudder. The fin member is connected to a strut configuration that extends over the tiller and the rudder, with the fin itself extending horizontally from the submerged end termination of the rudder. The fin is made of a flexible material that produces a good forward thrust when the tiller is moved back and forth, thus moving the sailboat forward at a sufficient speed.

10 Claims, 5 Drawing Sheets

PROPULSION DEVICE FOR SAILBOAT

CROSS-REFERENCE TO RELATED APPLICATIONS

This application claims the benefit of U.S. Provisional Application No. 61/983,064, filed Apr. 23, 2014 and herein incorporated by reference.

TECHNICAL FIELD

The present invention relates to a propulsion device for small sailboats with an external rudder.

BACKGROUND OF THE INVENTION

Sailboats need a means of moving when the wind is not blowing. Whether a sailor finds himself at the far end of a lake when the wind dies, or enters a sheltered harbor with little or no wind, he would welcome an easy way to move. On large boats this is accomplished by using an engine, but on small boats an engine is not often feasible. Using an oar or paddle is an option, but may be awkward and requires shifting from side to side. Sculling with the rudder can produce some forward motion but is not very efficient, since the rudder is designed for steering and is not configured to provide much forward thrust.

SUMMARY OF THE INVENTION

The needs remaining in the prior art are addressed by the present invention, which relates to a propulsion device for small sailboats with an external rudder.

In particular, the present invention takes the form of a flexible fin that is removably attached to a sailboat rudder. The fin member is connected to a strut configuration that extends over the tiller and the rudder, with the fin itself extending horizontally from the submerged end portion of the rudder. The fin is made of a flexible material that produces a good forward thrust when the tiller is moved back and forth, thus moving the sailboat forward at a sufficient speed.

In one embodiment, the strut is formed as a hinged configuration comprising a number of separate sections that rotate in a manner that allows for the strut to easily be folded up and stowed away when not in use, even in the smallest of sailboats.

Various arrangements may be used to attach the strut sections to the tiller and rudder, including elastic cords, "hook and loop" straps, etc. Any type of attachment mechanisms that allow for easy removal and re-attachment may be used. Various materials that are relatively flexible, yet sturdy, may be used for the fin portion of the propulsion device.

One particular embodiment of the present invention comprises propulsion device for use with a sailboat taking the form of a strut configuration for releasably attaching along an outer edge of a rudder and tiller combination, and a flexible fin connected to a lower portion of the strut configuration in the vicinity of a lower portion of a rudder such that as the tiller is moved, the flexible fin provides forward thrust.

Other and further embodiments and aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 2:
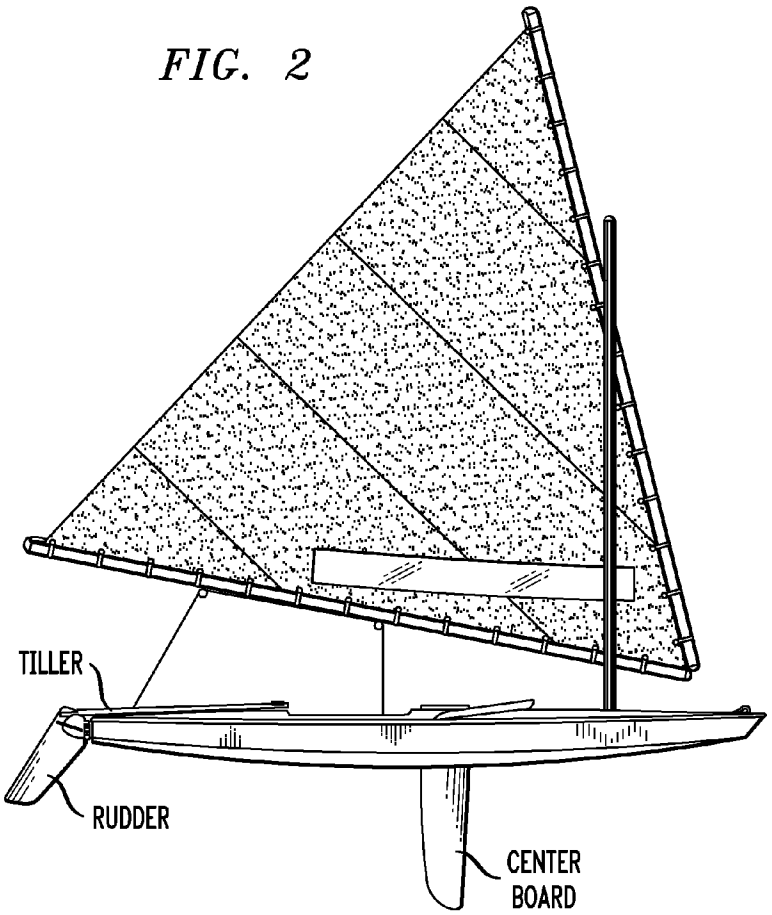
FIG. 2 is an illustration of a different type of sailboat, being particularly small and with relatively little storage area, that may use the propulsion device of the present invention.
Figure 1:
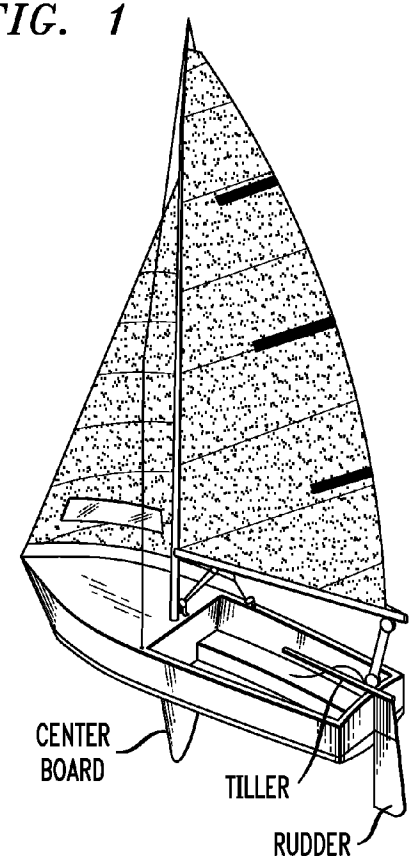
FIG. 1 is an illustration of a typical sailboat that may use the propulsion device of the present invention.

FIGS. 1 and 2 illustrate, in simplified diagrammatic form, two different types of sailboats that may benefit from using the propulsion device of the present invention. For the purposes of explanation and understanding of the principles of the inventive propulsion device, it is important to have basic working knowledge of the tiller and rudder components of such boats.

In the presence of a breeze or wind, a sailor steers the direction of a sailboat by moving the tiller, which is attached to the rudder (the terminal portion of the rudder being submersed). The movement of the tiller changes the direction of the forces applied by the water on the rudder, thus changing the direction of the boat's forward motion. As noted above, while the movement of the tiller is efficient in steering, the sculling action that the rudder can create is not efficient in producing sufficient forward motion in the absence of a breeze.

Figure 3:
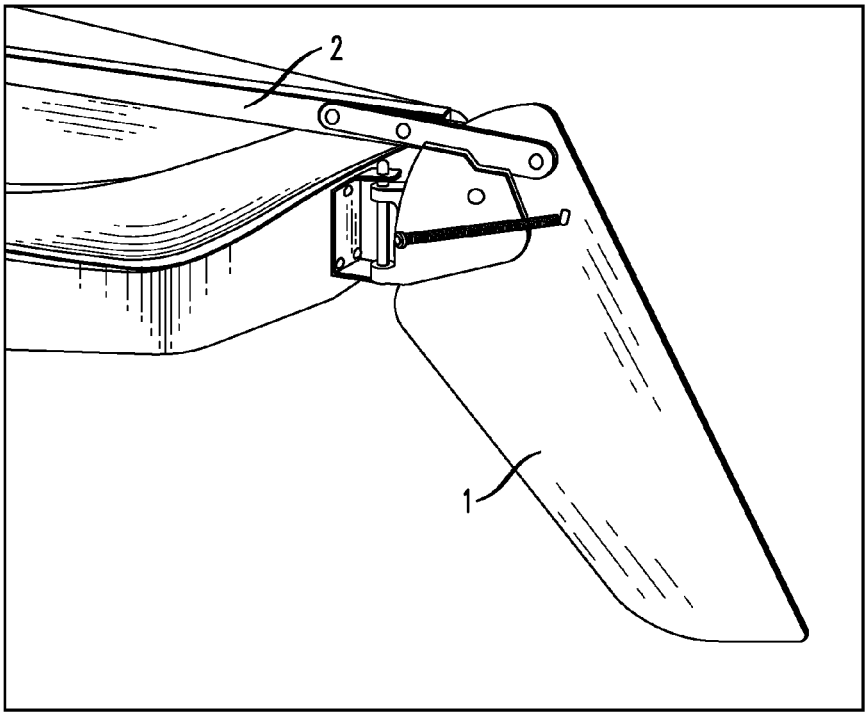
FIG. 3 is a close-up view of an exemplary tiller and rudder portion of a sailboat, this being the area of the sailboat where the inventive propulsion device is attached.

FIG. 3 is a close-up view of an exemplary rudder 1 and tiller 2 as attached in position on a rear portion of a sailboat. Various brackets used to attach rudder 1 to tiller 2, as well as to attach the combination to the boat itself, are shown in this view. With this basic understanding of the location and operation of the rudder and tiller components, the aspects of inventive propulsion device will now be described in detail.

Figure 4:
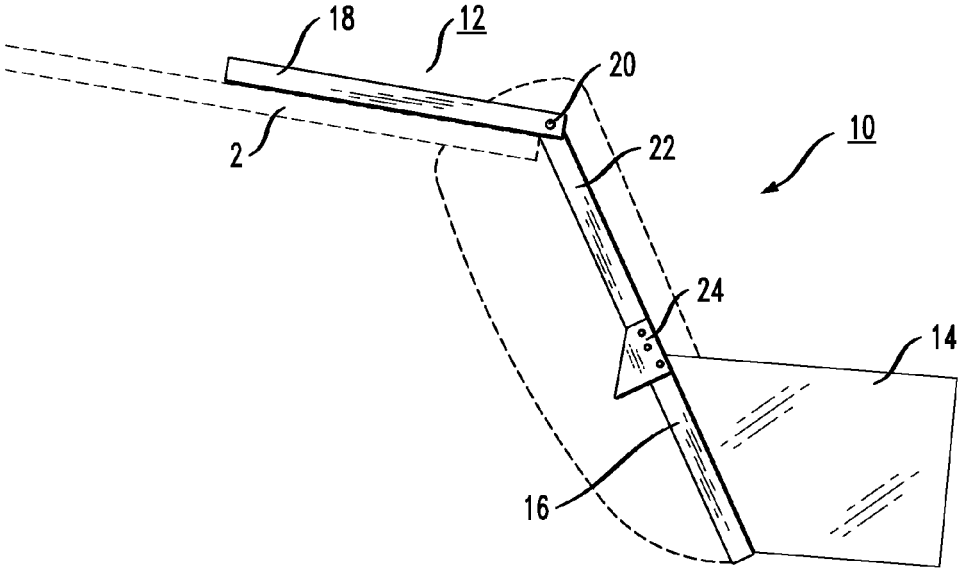
FIG. 4 illustrates an exemplary propulsion device formed in accordance with the present invention, comprising a strut fixture with a flexible fin connected to an end portion of the strut.

FIG. 4 illustrates an exemplary configuration of the present invention, shown as a propulsion device 10 comprising a strut configuration 12, with a flexible fin 14 connected to a lower strut section 16 of strut configuration 12. Flexible fin 14 is formed of a material that provides a good forward thrust when the tiller is moved back and forth. For example, a sheet of polycarbonate material (also known in the trade as Lexan) is considered a good alternative (although other appropriate materials may be used). Strut configuration 12 is shown as also including an upper strut section 18 which is positioned in place over an end region of a tiller (shown in phantom), where various means may be used to removably attach upper strut section 18 to the tiller (including simply tying the strut to the tiller). The remaining length of strut configuration 12 is positioned to rest against the outer edge of a rudder (also shown in phantom). An attachment device (described in detail below) is used to hold propulsion device 10 in place against the rudder. When placed over the tiller and rudder in this fashion, a back-and-forth movement of the tiller by the sailor will create a 'swimming' motion of flexible fin 14, enabling forward movement of the sailboat.

As mentioned above, a preferred configuration of the present invention utilizes a hinged strut configuration, formed of separate sections hinged together so that the strut may be folded for easy storage. Referring to FIG. 4, it is possible to include a first hinge member 20 at the connection between upper strut section 18 and the remainder of strut configuration 12, so that upper section 18 will fold against the longer leg of the strut for storage. In place of an actual "hinge", any type of suitable releasable attachment mechanism (such as a nut and bolt combination) may be used to attach the separate sections of the strut together.

In a particular embodiment of this preferred configuration, strut configuration 12 is formed of three separate sections: lower section 16 as discussed above (attached to flexible fin 14), upper section 18 (attached to the tiller), and a middle section 22 disposed between upper section 18 and lower section 16. In this case, upper section 18 and middle section 22 are connected via first hinge member 20, so that section 18 will fold against section 22. A second hinge member 24 is included in this embodiment, connecting middle section 22 to lower section 16, allowing the structure to fold into thirds to be stowed. As will be evident from the view shown in FIG. 7 (discussed below), the specific configuration of second hinge member 24 can be made to assist guiding the strut configuration into place along the rudder.

Figure 5:
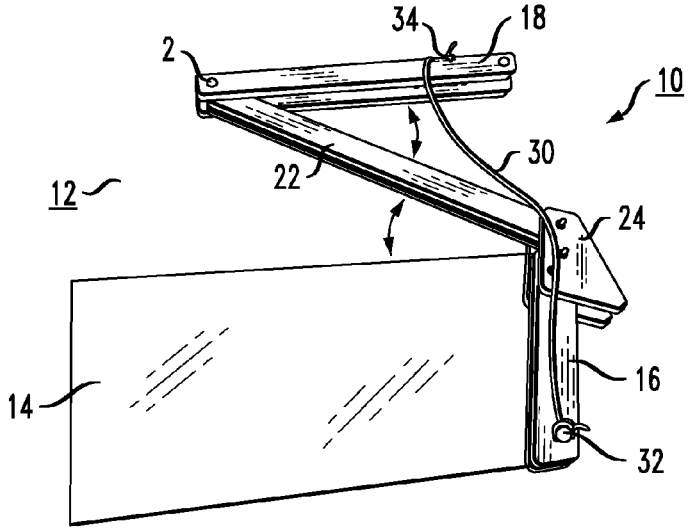
FIG. 5 illustrates an exemplary embodiment of the present invention where the strut is formed of a set of three separate sections that are hinged together, allowing for the propulsion device to be folded into a compact package when not in use, the view of FIG. 5 showing the propulsion device in a partially unfolded configuration.

FIG. 5 is another view of propulsion device 10, showing a hinged strut configuration in its partially-folded position, in this case with upper section 18 folded over toward middle section 22. Also shown in FIG. 5 is an elastic cord 30 that extends between a far end termination 32 of lower strut section 16 and a connection point 34 on upper strut section 18. When propulsion device 10 is fully extended over a tiller and a rudder, elastic cord 30 functions as the "attachment device" mentioned above to hold the strut sections in place along the outer edge of the rudder (not shown). The use of an elastic cord should be considered as only one exemplary arrangement for providing attachment of the strut to the rudder, various other attachment devices may be used.

Figure 6:
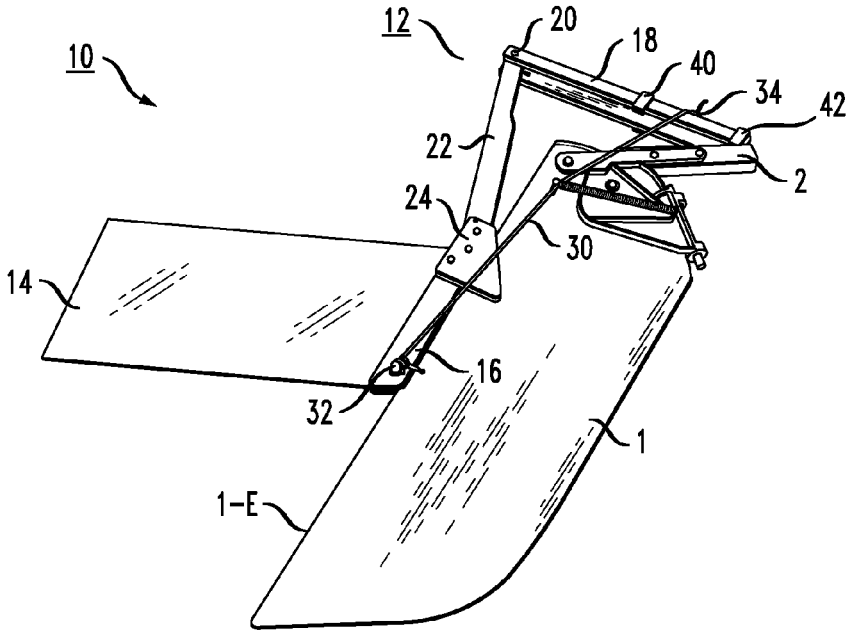
FIG. 6 shows the inventive propulsion device as partially installed over a sailboat rudder.
Figure 7:
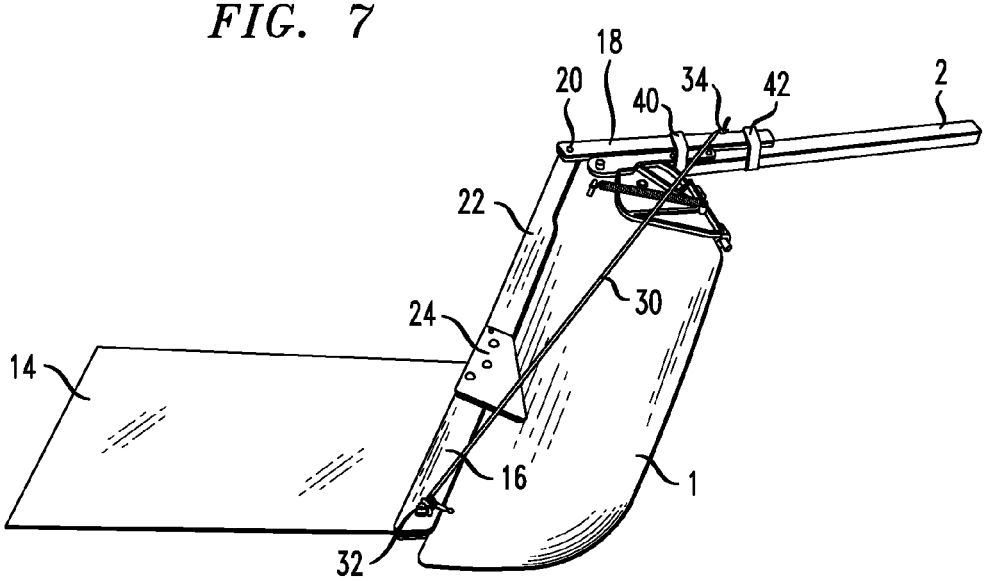
FIG. 7 shows the inventive propulsion device as fully installed over and attached to a sailboat rudder.

FIG. 6 illustrates propulsion device 10 as partially installed in place over an exemplary rudder 1 and tiller 2 (as previously identified in FIG. 3). As shown, lower strut section 16 is positioned against outer edge 1-E of rudder 1, with flexible fin 14 extending horizontally, essentially perpendicular to the direction of rudder 1. FIG. 7 illustrates propulsion device as fully in place over rudder 1 and tiller 2. As shown, second hinge member 24 functions as a guide, assisting the placement of lower and middle strut sections 16 and 22 against rudder 1. Additionally, in this position, elastic cord 30 is under sufficient tension to retain strut sections 16 and 22 in place along edge 1-E of rudder 1. Upper strut section 18 is shown as coextensive with an end portion of tiller 2. In this example, a pair of "hook and loop" attachment straps 40, 42 is used to hold upper strut section 18 in place against tiller 2. Of course, other types of releasable attachment mechanisms may be used to attach upper strut section 18 to tiller 2.

Figure 8:
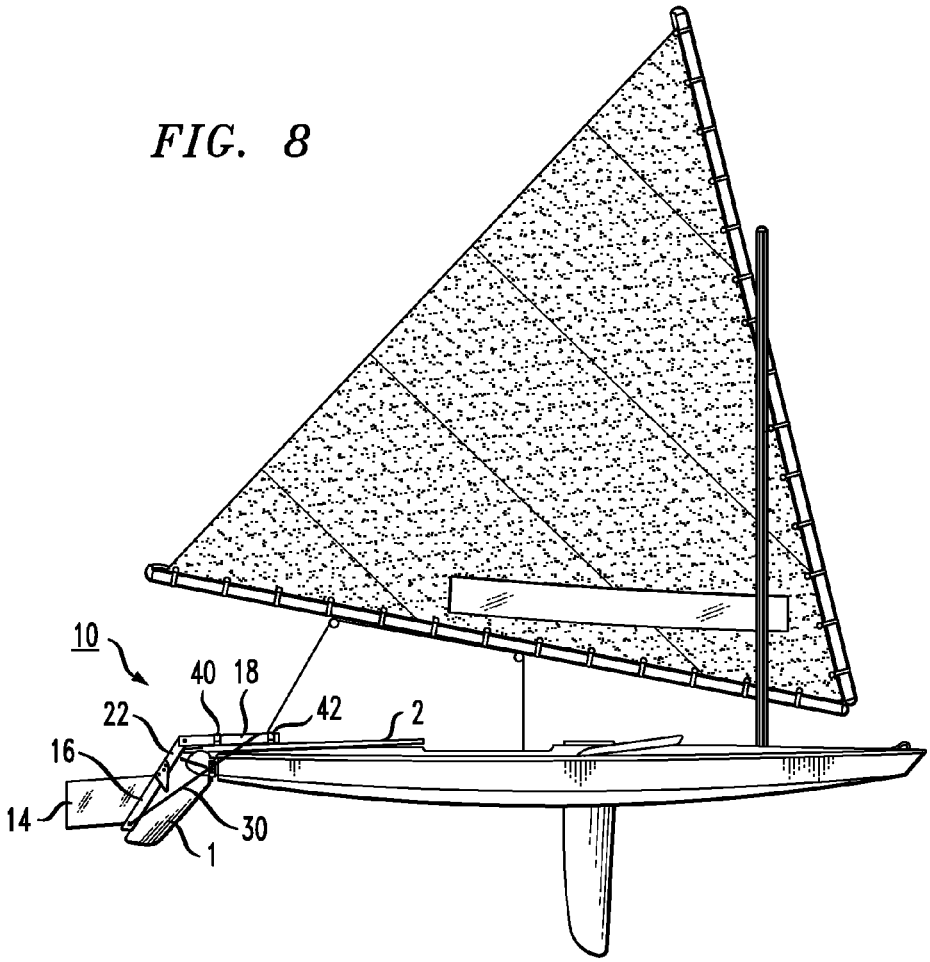
FIG. 8 is a diagram of the sailboat of FIG. 2 with a propulsion device of the present invention positioned in place over the tiller and rudder.

FIG. 8 shows the particular sailboat of FIG. 2 with propulsion device 10 in place along rudder 1 and tiller 2. Inasmuch as flexible fin 14 is held in place along the lower portion of rudder 1, flexible fin 14 will be at least partially immersed (including fully immersed) once propulsion device 10 is in place. In accordance with the present invention, when it is necessary to use flexible fin 14 to provide propulsion, tiller 2 is moved back and forth, which causes flexible fin 14 to act as a flipper against the water and provide forward thrust.

Figure 9:
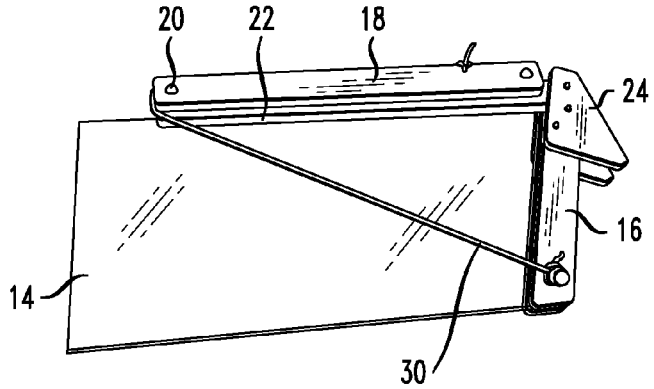
FIG. 9 shows the inventive propulsion device in its storage configuration, with a hinged strut configuration folded in thirds.

In a preferred configuration, the use of a hinged strut configuration allows for the inventive propulsion device to be folded up and stowed within the sailboat when not in use. This is obviously preferred so as to prevent flexible fin 14 from interfering with the steering capabilities of rudder 1. In a preferred configuration using an elastic cord and releasable fasteners, these items may be used in keep the folded strut sections together when stored. FIG. 9 shows propulsion device 10 in its folded position. As obvious from the illustration of FIG. 3, propulsion device 10 is able to be easily stowed when not in use.

While the preferred embodiments of the present invention have been described, additional variations and modifications in those embodiments may occur to those skilled in the art. Therefore, it is intended that the appended claims shall be construed to include both the preferred embodiment and modifications as fall within the spirit and scope of the present invention.

What is claimed is:

1. A propulsion device for use with a sailboat equipped with a rudder and a tiller, the propulsion device comprising a strut configuration releasably attachable along a portion of the tiller and attaching along an outer edge of the rudder; and a flexible fin connected to a lower portion of the strut configuration in the vicinity of a lower portion of rudder such that as the tiller is moved, the flexible fin provides forward thrust.

2. The propulsion device of claim 1 wherein the strut configuration comprises a plurality of separate sections, including an upper section for releasably attaching to a tiller and a lower section, with the flexible fin connected to the lower section.

3. The propulsion device of claim 2 wherein the strut configuration further comprises a first releasable attachment element for connecting the upper section to the lower section.

4. The propulsion device of claim 3 wherein the first releasable attachment element comprises a first hinge member.

5. The propulsion device of claim 2 wherein the strut configuration further comprises a middle section disposed between the upper and lower sections, the middle strut section positioned against an upper portion of the rudder.

6. The propulsion device of claim 5 wherein the strut configuration is formed as a hinged configuration, with a first hinge element connecting an end region of the upper strut section to a first end region of the middle strut section, and a second hinge element connecting a second, opposing end region of the middle strut section to an end region of the lower strut section, the hinges moving the strut configuration between a folded arrangement for storage and an opened arrangement for attachment to the tiller and rudder combination.

7. The propulsion device of claim 6 wherein the second hinge element is configured to provide guidance for the placement of the lower and middle strut sections with respect to a rudder.

8. The propulsion device of claim 1 wherein the device further comprises an elastic tension cord disposed between a distal end region of the strut in proximity to the flexible fin, and a terminal end region of the strut in proximity to an opposing end along the tiller, the elastic tension cord providing additional force for holding the propulsion device in place against the rudder and tiller combination.

9. The propulsion device of claim 1 wherein the device further comprises releasable attachment straps for attaching the upper end of the strut configuration to the tiller.

10. The propulsion device of claim 1 wherein the flexible fin comprises a sheet of polycarbonate material.

* * * * *